United States Patent [19]

Yoshida et al.

[11] Patent Number: 4,576,027

[45] Date of Patent: Mar. 18, 1986

[54] ROLLING MILL

[75] Inventors: Fumio Yoshida; Yoshikazu Kotera, both of Hyogo, Japan

[73] Assignee: Mitsubishi Denki Kabushiki Kaisha, Tokyo, Japan

[21] Appl. No.: 550,545

[22] Filed: Nov. 10, 1983

[30] Foreign Application Priority Data

Feb. 25, 1983 [JP] Japan ..... 58-31202

[51] Int. Cl.[4] ..... B21B 37/12

[52] U.S. Cl. ..... 72/11; 72/16; 72/17; 72/20; 72/21; 364/472

[58] Field of Search ..... 72/8, 9, 11, 12, 16, 72/17, 20, 21, 234; 364/472

[56] References Cited

U.S. PATENT DOCUMENTS

| | | | |
|---|---|---|---|
| 3,766,761 | 10/1973 | Adair et al. | 72/8 |
| 3,787,667 | 1/1974 | King et al. | 72/8 X |
| 3,803,887 | 4/1974 | Kitanosono | 72/11 |
| 3,906,764 | 9/1975 | Mueller | 72/21 X |
| 4,415,976 | 11/1983 | Cook | 72/8 X |

*Primary Examiner*—Francis S. Husar
*Assistant Examiner*—Steven B. Katz
*Attorney, Agent, or Firm*—Bernard, Rothwell & Brown

[57] ABSTRACT

A rolling mill in which the size of a rolling material at the outgoing side of rolls and the reaction force from the material exerted to the rolls are successively obtained from respective sampling periods to be used as data for calculating the most reliable mill modulus of the mill and an offset value of the roll gap by an arithmetic operation, which are fed to a rolling control system for controlling the rolls.

9 Claims, 5 Drawing Figures

ROLLING MILL

FIELD OF THE INVENTION

The present invention relates to a rolling mill which includes a processing unit in the feedback control loop to provide improved rolling accuracy. More particularly, this invention relates to a rolling mill for compensating with a high accuracy the mill modulus of a rolling mill and the offset value of the roll gap of the mill.

BACKGROUND OF THE INVENTION

In order to improve the rolling accuracy, it is necessary to know with a high accuracy the mill modulus of a mill under rolling process and the offset value of the roll gap of a rolling mill. However, since the mill modulus, the offset value and the reaction force at the start and during rolling are different, it is necessary to update those values with the most reliable and latest values in accordance with the actual rolling state, which is discussed in the paper entitled "Mill modulus variation and hysteresis - Their effect on hot strip mill AGC" by G. E. Wood published in Iron and Steel Engineer, January 1977, pages 65–70. Further in the paper entitled "Adaptive control" by Torsten Cegrell, ASEA JOURNAL, 1978, Vol. 51, No. 3, pages 75–77: says "it is possible to determine the parameter values with the aid of the technique of recursive least squares," and shows therein theoretical grounds of this statement.

Referring to FIG. 1, there is shown a sectional view of a rolling mill in an ordinary rolling process, in which a top work roll (TR) 1 and a bottom work roll (BR) 2 of the rolling mill are opposed to each other with a gap S forming therebetween. A rolling material (m) 3 is rolled to a plate of thickness h as it moves to the right in the figure. At this time, the rolls receive a reaction force F from the material to force the gap S to be changed. The relationship between the roll gap S and the reaction force F is shown in FIG. 2, in which the roll gap S increases as the reaction force increases, as indicated by line A and in which the gradient M of the line represents a mill modulus which corresponds to the magnitude of rigidity of the rolling mill. The plate thickness h has the following relationship with the roll gap S and the reaction force F:

$$h=F/m+S+K \tag{1}$$

wherein K represents an offset value of the roll gap.

In conventional rolling mills, however, the mill modulus M and the offset value K are fixedly given, even if those values may change in the actual rolling state so that a high rolling accuracy has heretofore been unobtainable.

OBJECT OF THE INVENTION

It is the object of the present invention to provide a rolling mill having an improved rolling accuracy by calculating the most reliable value of a mill modulus and an offset of the roll gap during the actual rolling state of the rolling mill so as to successively feed back those values to a rolling control system.

SUMMARY OF THE INVENTION

The present invention is a rolling mill for rolling an elongated transferring material continuously through at least a pair of rolls opposed to each other with a gap formed therebetween, in which the size of the rolling material and the reaction force therefrom exerted to the rolls are successively provided as data to a processing unit, which in turn determines by an arithmetic operation the most reliable mill modulus of the rolling mill and offset of the roll gap, this data being obtained during respective sampling periods, and provides those resultant values as the present size and reaction force of the material to a rolling control system for controlling the rolls.

DESCRIPTION OF THE PREFERRED EMBODIMENTS

Figure 3:
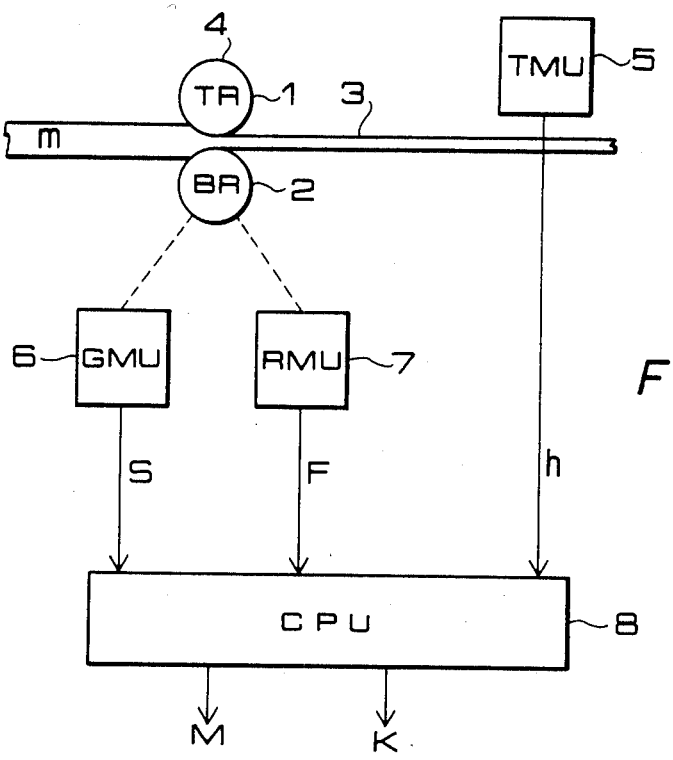
FIG. 3 is a block diagram of rolls and a control system in a rolling mill according to a first embodiment of the present invention.

Referring to FIG. 3, there is shown a block diagram of a rolling mill embodying the present invention, in which a rolling material 3 which is being rolled by a pair of a top roll (TR) 1 and a bottom roll (BR) 2 is measured for its thickness h by means of a thickness measuring unit (TMU) 5 disposed on the outgoing side of a rolling mill 4. The thickness h thus measured is provided as data to a processing unit (CPU) 8. A roll gap S formed between the rolls 1 and 2 and a reaction force F exerted to those rolls are measured by a gap measuring unit (GMU) 6 and a reaction force measuring unit (RMU) 7 attached thereto respectively, which are also provided to the processing unit 8. The processing unit, which comprises for example a computer which thus receives the output signals indicative of the plate thickness h, roll gap S and reaction force F then calculates the mill modulus M and the offset value K of the roll gap in accordance with the equation shown below, which are fed back to a roll controlling section (not shown) of the rolling mill.

The arithmetic operation of the processing unit 8 will now be explained. The foregoing equation (1) may be rewritten as follows:

$$F/M+K=h-S \tag{2}$$

The equation (2) may be expressed with a following determinant:

$$(F,\ 1)\begin{pmatrix} \frac{1}{M} \\ K \end{pmatrix} = h - S \tag{3}$$

Therefore, the following equation is established for F, h and S of n (=1, 2, . . . ) sample data obtained at predetermined time intervals during rolling:

$$\begin{pmatrix} F_1, 1 \\ F_2, 1 \\ \cdot\ \cdot \\ \cdot\ \cdot \\ \cdot\ \cdot \\ F_n, 1 \end{pmatrix} \begin{pmatrix} \frac{1}{M} \\ K \end{pmatrix} = \begin{pmatrix} h_1 - S_1 \\ h_2 - S_2 \\ \cdot \\ \cdot \\ \cdot \\ h_n - S_n \end{pmatrix} \quad (4)$$

1/M and K as desired most reliable values can be obtained using the equation (4) and in accordance with the following equation:

$$\begin{pmatrix} \frac{1}{M} \\ K \end{pmatrix} = (\dot{X}_T \cdot \dot{X})^{-1} \dot{X}_T \cdot \dot{Y} \quad (5)$$

where $$\dot{X} = \begin{pmatrix} F_1, 1 \\ F_2, 1 \\ \cdot\ \cdot \\ \cdot\ \cdot \\ \cdot\ \cdot \\ F_n, 1 \end{pmatrix}$$

$$\dot{X}_T = \begin{pmatrix} F_1, F_2, \ldots, F_n \\ 1, \ 1 \qquad 1 \end{pmatrix}$$

$$\dot{Y} = \begin{pmatrix} h_1 - S_1 \\ h_2 - S_2 \\ \cdot \\ \cdot \\ \cdot \\ h_n - S_n \end{pmatrix}$$

Thus, the processing unit calculates the mill modulus M and offset value K as the present most reliable values successively using plate thickness $h_1 - h_n$, roll gap $S_1 - S_n$ and reaction force $F_1 - F_n$ of the n (=1, 2, . . . ) sample data obtained under actual rolling conditions, and those values are provided to the roll controlling section to improve the rolling accuracy.

Figure 4:
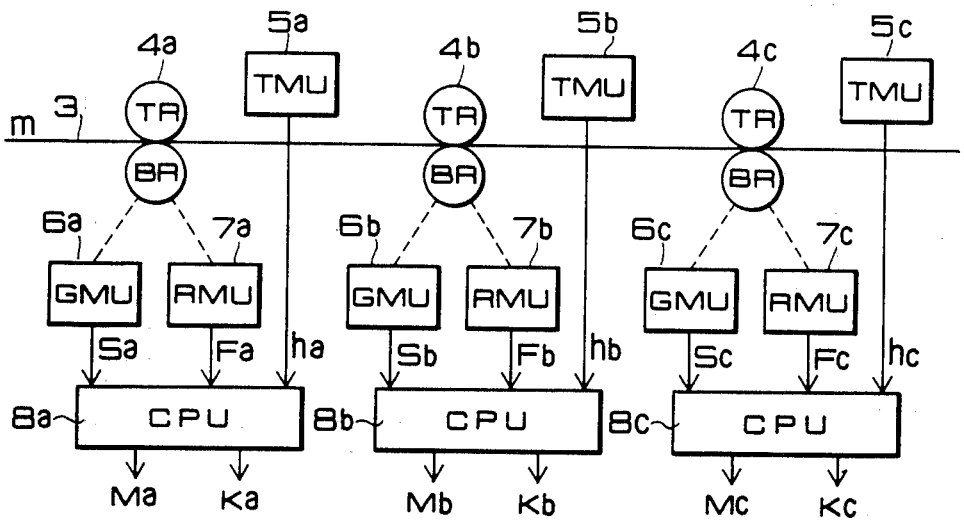
FIG. 4 is a block diagram of plural sets of rolls and associated control systems in a rolling mill according to a second embodiment of the present invention.

Referring now to FIG. 4, there is shown a block diagram of a rolling mill according to a second embodiment of the present invention, in which sets of rolls are disposed in series and the same components to that of FIG. 3 are indicated by the same reference numeral, and for the purpose of making distinction between them, a suffix of "a", "b" or "c" is attached thereto. Processing units 8*a*, 8*b* and 8*c* receive output signals indicative of plate thicknesses $h_a$, $h_b$, $h_c$, roll gaps Sa, Sb, Sc and reaction forces Fa, Fb, Fc from the respective associated thickness measuring units 5*a*, 5*b*, 5*c*, gap measuring units 6*a*, 6*b*, 6*c* and reaction force measuring units 7*a*, 7*b*, 7*c*, and execute the arithmetic operation of the equation (5) to calculate mill moduli Ma, Mb, Mc and offset values Ka, Kb, Kc.

Figure 2:
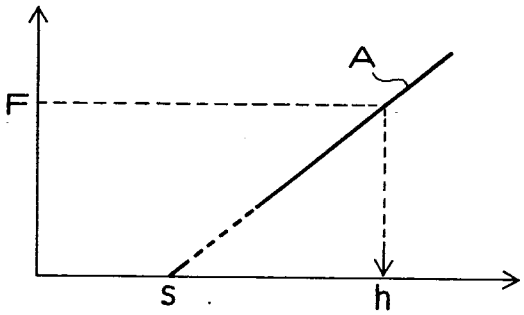
FIG. 2 is a graph showing the relationship between the roll gap and the reaction force induced during rolling.
Figure 1:
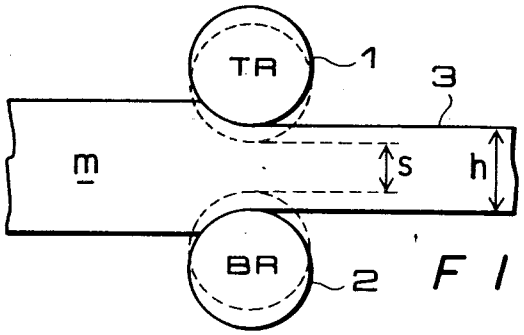
FIG. 1 is a sectional view of rolls which are rolling a rolling material.
Figure 5:
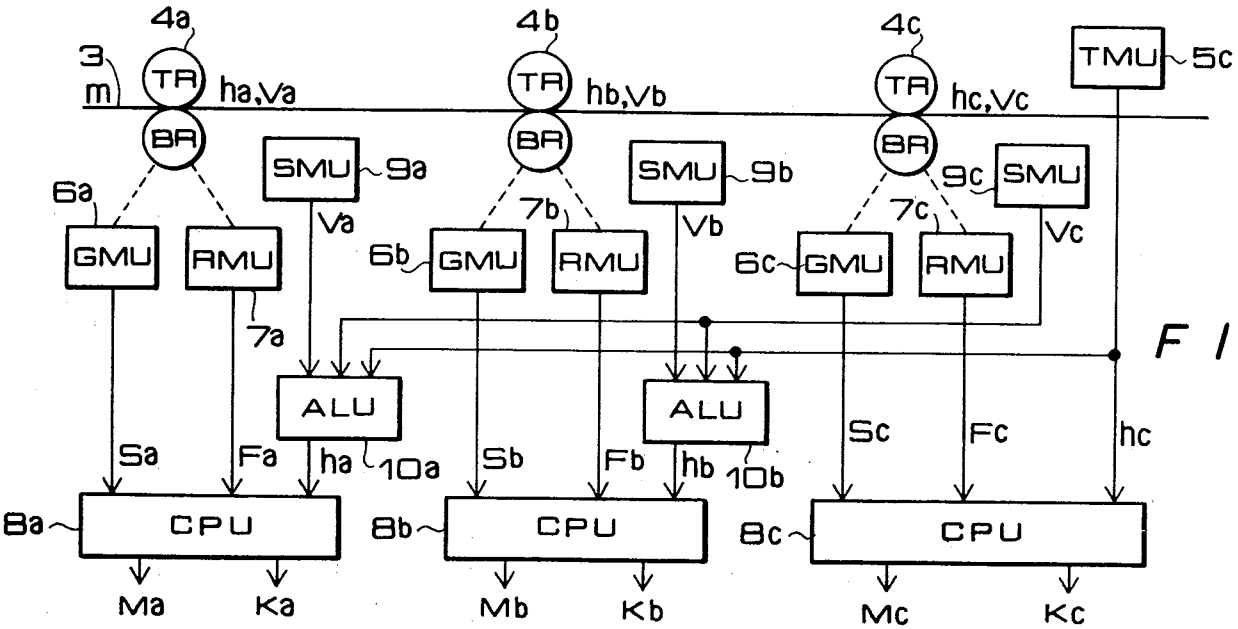
FIG. 5 is a block diagram of plural sets of rolls and associated control systems in a rolling mill according to a third embodiment of the present invention.

Referring now to FIG. 5, there is shown a block diagram of a rolling mill according to a third embodiment of the present invention, in which plural sets of rolls are disposed in series and the same components to that of FIG. 4 are indicated by the same reference numerals as in FIG. 4. It should be noted that no thickness measuring unit is disposed on the outgoing sides of rolls 4*a* and 4*b*. However, on the outgoing sides of rolls 4*a*, 4*b*, 4*c* and along the material 3, there are disposed speed measuring units (SMU) 9*a*, 9*b* and 9*c* for measuring transferring velocities Va, Vb and Vc, respectively, of the rolling material 3. Further, arithmetic and logic units (ALU) 10*a* and 10*b* are provided, which respectively receive velocities Va, Vc, thickness hc and velocities Vb, Vc, thickness hc. The arithmetic and logic units determine the thicknesses $h_a$ and $h_b$ on the outgoing sides of rolls 4*a* and 4*b* by a trial calculation in accordance with the following equation (6):

$$\left.\begin{aligned} h_a &= h_c \times \frac{V_c}{V_a} \\ h_b &= h_c \times \frac{V_c}{V_b} \end{aligned}\right\} \quad (6)$$

The plate thicknesses $h_a$ and $h_b$ thus obtained by the arithmetic and logic units 10*a* and 10*b* are fed to the respective processing units 8*a* and 8*b*, which in turn execute the arithmetic operation of the equation (5).

Although in the foregoing embodiments the absolute value of plate thickness is measured by the thickness meter, there may used a known X-ray thickness meter to measure a deviation from a reference plate thickness, and the plate thickness as an absolute value may be obtained by the addition of the reference plate thickness and the deviation by means of a processing unit.

Further, although in the embodiment of FIG. 5 the moving speed of the material is detected by means of a speed detector, it may also be detected by multiplying the peripheral speed of the work rolls of the rolling mill by the advancing factor of the rolled plate.

In the above embodiments, moreover, although the rolls are controlled through the parameters associated with thickness of the material, it may also controlled through the parameters associated with the width of the material. In this case, the thickness h and gap S in the equations (1)-(6) may be read as plate width W and roll gap in the width direction, respectively. And in the embodiments shown in FIGS. 1-5, the thickness h, the top and bottom work rolls and the thickness measuring unit may be read as plate width W, work rolls in the width direction and width measuring unit, respectively.

Further, although the arithmetic and logic units 10*a* and 10*b* are provided in the embodiment of FIG. 5, their functions may alternatively be executed by the processing units 8*a* and 8*b*.

What is claimed is:

1. A rolling mill for rolling an elongated transferring material continuously through at least a pair of rolls opposed to each other with a gap forming therebetween, said rolling mill including:

a plurality of measuring means for measuring data, including size of the material, the gap between the rolls, and the reaction force exerted on the rolls, associated with said rolls; and arithmetic processing means connected to said measuring means for receiving and utilizing said data during a plurality of successive sampling periods from said measuring means to execute a predetermined arithmetic processing to separately calculate the most reliable values of a mill modulus which said rolling mill possesses and an offset of said gap, and providing the values as input data for controlling said rolls, said arithmetic processing means being provided for each of said pair of rolls.

2. A rolling mill according to claim 1, wherein said measuring means are provided for each said pair of rolls and include a first measuring means disposed on the outgoing side of the rolls for measuring the size of the material, a second measuring means for measuring a rolling reaction force from the material exerted to the rolls and a third measuring means for measuring the gap between said rolls during rolling.

3. A rolling mill according to claim 1 including a plurality of pairs of rolls for successively rolling the material, wherein said measuring means are provided for each said pair of rolls and include a first measuring means disposed on the outgoing side of the rolls for measuring the moving velocity of the material, a second measuring means for measuring a reaction force from the material exerted to the rolls and a third measuring means for measuring the gap between said rolls during rolling, said measuring means at the last stage including a fourth measuring means disposed on the outgoing side of the associated pair of rolls for measuring the size of the material.

4. A rolling mill according to claim 1 wherein said arithmetic processing means comprises a computer, and said arithmetic processing includes a matrix calculation of a degree corresponding to the number of samples.

5. A rolling mill according to claim 1 including a plurality of pairs of rolls for successively rolling the material, said plurality of pairs of rolls including upstream and downstream pairs of rolls, wherein said arithmetic processing means includes a matrix calculation of a degree corresponding to the number of samples and provided for said upstream rolls for calculating the size of the material at the outgoing side of each pair of rolls with the data of the moving velocity of said material received from said measuring means corresponding thereto and the data of the size received from said measuring means corresponding to said downstream pair of rolls.

6. A rolling mill according to claim 1, wherein the size of the material is the thickness of the rolled material.

7. A rolling mill according to claim 1, wherein the size of the rolled material is the width of the rolled material.

8. A rolling mill according to claim 2, wherein said arithmetic processing means comprises a computer, and said arithmetic processing includes a matrix calculation of a degree corresponding to the number of samples.

9. A rolling mill according to claim 3, including a plurality of pairs of rolls for successively rolling the material, said plurality of pairs of rolls including upstream and downstream pairs of rolls, wherein said arithmetic processing means includes a matrix calculation of a degree corresponding to the number of samples, said arithmetic processing means provided for said upstream pair of rolls calculating the size of the material at the outgoing side of the associated rolls with the data of the moving velocity of said material received from said measuring means corresponding thereto and the data of the size received from said measuring means corresponding to said downstream pair of rolls.

* * * * *